United States Patent [19]

Ogawa

[11] 4,196,426

[45] Apr. 1, 1980

[54] COMBUSTION PRODUCTS DETECTION APPARATUS

[75] Inventor: Francis T. Ogawa, Lakewood, Colo.

[73] Assignee: Emerson Electric Company, St. Louis, Mo.

[21] Appl. No.: 923,219

[22] Filed: Jul. 10, 1978

[51] Int. Cl.[2] ..... G08B 17/10

[52] U.S. Cl. ..... 340/629; 250/381

[58] Field of Search ..... 340/628, 629; 250/381, 250/382, 384, 385, 389, 393

[56] References Cited

U.S. PATENT DOCUMENTS

| | | | |
|---|---|---|---|
| 3,906,474 | 9/1972 | Lehsten | 250/384 X |
| 4,081,795 | 3/1978 | Ogawa | 340/629 |
| 4,097,850 | 6/1978 | Conforti | 340/629 |
| 4,138,670 | 2/1979 | Schneider et al. | 340/629 X |

*Primary Examiner*—John W. Caldwell, Sr.
*Assistant Examiner*—Daniel Myer
*Attorney, Agent, or Firm*—Sheridan, Ross, Fields & McIntosh

[57] ABSTRACT

A self-monitoring ion chamber type combustion products detection apparatus operable to generate perceptibly different output signals indicative of, respectively: the apparatus is being tested; the condition of the apparatus is normal; an alarm condition is detected; an apparatus malfunction is detected; and, a low power supply voltage is detected. The impedance of the ion chamber of the apparatus varies as a function of the degree of combustion products in the atmosphere being monitored and this change in impedance produces a variation in the output voltage of the ion chamber which is used by the apparatus to produce an alarm signal. In generating different output signals, the apparatus employs test, alarm, fault and low power supply reference voltages. An oscillator circuit is selectively driven by one or more substantially constant current sources to produce output pulses having predetermined frequencies which are utilized in producing at least some of the perceptibly different output signals. A battery may be used to provide power for the apparatus, and the perceptibly different output signals are preferably produced as visible light or audible sound signals.

19 Claims, 1 Drawing Figure

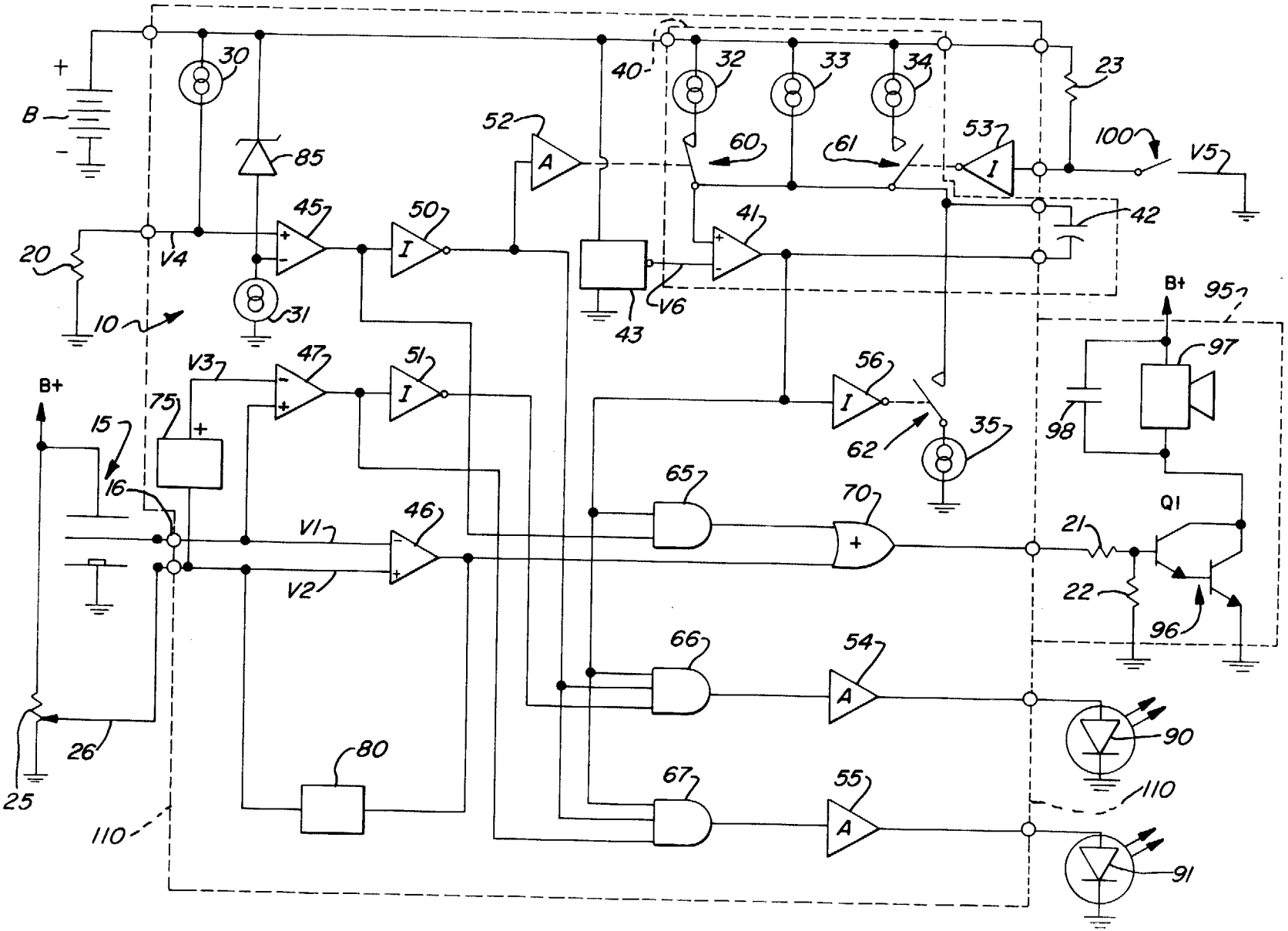
B+
Q1
V1
V2
V3
V4
V5
V6
B
+
-

COMBUSTION PRODUCTS DETECTION APPARATUS

BACKGROUND OF THE INVENTION

The present invention relates to a combustion products detection apparatus. Such devices are commonly referred to as fire and smoke detectors. Fire and smoke detectors generally detect the presence of fire by utilizing ion chambers to monitor and measure the presence of smoke and other combustion products or particles in the atmosphere. An increase in the amount, or degree, of smoke and combustion products in the atmosphere being monitored by an ion chamber increases the impedance of the ion chamber, and if a substantially constant voltage is applied across the chamber, causes the ion current flowing through the chamber to proportionately decrease. Such changes in the ion current are utilized to generate the alarm signal when products of combustion are detected, which products are indicative of the existence of a fire.

Fire and smoke detectors are employed and relied upon for the purpose of preventing and reducing property loss and loss of lives through the early detection of fire. Consequently, it is important that their operation be reliable and that any malfunction therein be quickly detected and identified.

SUMMARY OF THE INVENTION

Accordingly, it is an object of the present invention to provide an improved ion chamber type combustion products detection apparatus which is characterized by being reliable and self-monitoring.

It is a further object of the present invention to provide an improved ion chamber combustion products detection apparatus characterized by being capable of detecting malfunctions in its operation.

It is also an object of the present invention to provide an improved ion chamber combustion products detection apparatus in which the power source may be a battery and which apparatus is characterized by being able to monitor the voltage of its power source.

In accomplishing these and other objects, there is provided a self-monitoring ion chamber combustion products detection apparatus which produces perceptibly different output signals indicative of the fact that the apparatus is being tested; that the apparatus is operating normally; that an alarm condition has been detected; that the apparatus has detected a malfunction; and that the apparatus has detected that the voltage of the power supply has dropped below a predetermined value. The ion chamber in the apparatus generates a variable output voltage which is a function of the degree, or amount, of combustion products in the atmospher being monitored. In generating the different output signals, the apparatus employs test, alarm, fault and low power source reference voltages and utilizes an oscillator circuit which is selectively driven by one or more substantially constant current sources. A battery may be used to power the apparatus. The perceptibly different output signals are preferably in the form of light or sound signals or both.

Additional objects of the present invention reside in the construction of the exemplary embodiment of the combustion products detection apparatus shown in the single FIGURE drawing and hereinafter described in conjunction therewith.

BRIEF DESCRIPTION OF THE DRAWING

The single FIGURE is a circuit diagram of a combustion products detection apparatus according to the present invention.

DESCRIPTION OF THE PREFERRED EMBODIMENT

Referring to the drawing, there is shown a battery powered ion chamber combustion products detection device, or apparatus 10. Battery B is the power supply for apparatus 10. Apparatus 10 as illustrated is made up of the following components: an ion chamber 15 having an output terminal 16; fixed resistors 21, 22, 23; a variable resistor 25 having an adjustable voltage pickoff 26; conventionally constructed substantially constant current sources 31, 32, 33, 34, 35, such as field effect current regulating diodes, which current sources are powered by battery B; an oscillator circuit 40 is formed by operational amplifier 41, timing capacitor 42, and reference voltage source 43. Reference voltage source 43 is connected to the power source, battery B, and in a preferred embodiment is a circuit which includes a nonlinear device such as a zener diode or equivalent; operational amplifiers 45, 46, 47 are connected as comparators; inverters 50, 51, amplifiers 52, inverter 53, amplifiers 54, 55, and inverter 56; transmission gates 60, 61, 62 which in a preferred embodiment are FET gates; conventional AND gates 65, 66, 67; conventional OR gate 70; reference voltage source 75 which in a preferred embodiment is a conventional bridge network powered by battery B but it could also be a battery; a conventional hysteresis compensating feedback circuit 80 whose function is to delay the change in the value of the input voltage to comparator 46 in response to a change in the output; a zener diode 85; light emitting diodes 90, 91; a horn circuit 95 made up of a transistor driving circuit 96, horn 97 and capacitor 98 connected to shunt the horn 97; and a switch 100 for switching apparatus 10 into its test mode.

As hereinafter explained, apparatus 10 is a battery powered self-monitoring ion chamber type combustion products detection apparatus operable to generate perceptibly different outputs, or output signals, indicative of respectively: the apparatus is in its test mode; the apparatus is in its normal operating mode; an alarm condition has been detected; a malfunction of the apparatus has been detected; and a low battery voltage has been detected. For the purposes of explaining the operation of the apparatus 10, the following voltage signals are designated: V1, V2, V3, V4, V5 and V6. In the preferred embodiment, the voltage of battery B, the source of electrical power for apparatus 10, is 9 volts and is connected with its negative terminal grounded. Hence the B+ voltage shown on the drawing is +9 volts DC.

As shown in the drawing, voltage V1 is the ion chamber voltage, i.e., the voltage of output terminal 16 of ion chamber 15. Voltage V1 varies as a function of the amount, or degree, i.e., the number of particles of combustion products in the atmosphere. The value of V1 when the air being monitored is clear is designated as $V1_{CA}$. Voltage V1 decreases from $V1_{CA}$ as the amount of combustion products in the atmosphere being monitored increases, or V1 is an inverse function of the amount of combustion products present.

Voltage V2, the alarm reference voltage, is the voltage of pickoff 26 of variable resistor 25 and is appropriately set by adjusting the position of pickoff 26 on variable resistor 25. In a preferred embodiment of apparatus 10, alarm reference voltage V2 is set 2 volts DC below $V1_{CA}$.

Voltage V3, the apparatus fault reference voltage, is applied to the negative input terminal of comparator 47 and is equal to the sum of V2 plus the voltage difference generated by reference voltage circuitry 75. In the preferred embodiment of apparatus 10 the magnitude of the reference voltage produced by circuit 75 is +2.3 volts DC so that the voltage V3 is 2.3 volts DC greater or more positive than V2 and 0.3 volts DC more positive than $V1_{CA}$. Thus V1, when conditions are normal, lies between, or within the voltage range defined by, the reference voltages V2 and V3.

Voltage V4 is the low battery, or power source reference voltage and is applied to the positive input terminal of comparator 45. Voltage V4 is generated across resistor 20 by current from substantially constant current source 30 and in a preferred embodiment of apparatus 10 is 7.5 volts DC, 1.5 volts below the normal output voltage of battery B.

Voltage V5 is the test reference voltage and is used to bias or place apparatus 10 in its test mode. V5 is at ground potential in the preferred embodiment.

Voltage V6 produced by reference voltage source 43 is a DC reference voltage which is applied to the negative input terminal of op. amp. 41.

Prior to or during the operation of apparatus 10, its oscillator circuit 40 and the operation of apparatus 10 may be tested by closing switch 100. Closing switch 100 applies a ground potential to inverter 53. Inverter 53 produces a positive output signal which is applied to gate 61 which causes the gate 61 to close or become conductive. Gate 60 will also be closed, or conducting, if the output voltage of battery B is within operational limits, as will be explained later, and as a result the currents from substantially constant current sources 32, 33 and 34 will charge the timing capacitor 42 at a maximum rate. Initially it should be noted that switch 62 will be open to permit capacitor 42 to be charged by the currents from sources 32, 33, 34. As the voltage builds up on capacitor 42, at some point in time the voltage across capacitor 42 will become greater than the reference voltage V6 from reference voltage source 43 applied to the negative input terminal of op. amp. 41, which causes op. amp. 41 to produce a positive output signal or a logic HIGH signal which is applied to inverter 56. Inverter 56 produces a negative or logic LOW signal which closes switch 62 to discharge capacitor 42 through constant current source 35. The rate at which capacitor 42 charges depends upon the magnitude of the charging current, so that the maximum frequency of oscillator 40 occurs when current from the three sources 32, 33 and 34 are used to charge capacitor 42. The values of the circuit elements are chosen so that in this condition in the preferred embodiment, oscillator 40 will produce output pulses at intervals of about one each 0.5 seconds. The output pulses are generated at the output terminal of op. amp. 41 and are transmitted therefrom as logic HIGHS to AND gates 65, 66, and 67. The output terminal of op. amp. 41 is also connected to inverter 56 which inverts a positive signal or a logic HIGH to a logic LOW which causes transmission gate 62 to close to discharge capacitor 42 through the constant current source 35. The magnitudes of the currents produced by constant current sources 32, 33, 34 and 35 are chosen so that source 35 is greater than the sum of those produced by sources 32, 33 and 34. As a result, each output pulse produced by oscillator 40 will have a substantial uniform duration or width of approximately 10 milliseconds in the preferred embodiment.

If the output voltage of battery B is equal to or greater than 7.5 volts DC at the negative input terminal of op. amp. 45, the output of op. amp. 45 will be negative or a logic LOW. This logic LOW is inverted by inverter 50 into a logic HIGH which is applied to AND gates 66 and 67 and to amplifier 52. A positive or logic HIGH output from amplifier 52 causes gate 60 to close or become conductive so that current from source 32 is available to charge timing capacitor 42.

If V1 is below the fault reference voltage V3, then the output voltage of op. amp. 47 will be negative or a logic LOW which will be inverted by inverter 51 and applied to one of the input terminals of AND gate 66 as a logic HIGH. The presence of logic HIGHS at two of the three input terminals of AND gate 66, enables gate 66 so that each time a positive output pulse from oscillator circuit 40 is applied to the third input terminal of gate 66, gate 66 will conduct. The positive or logic HIGH at the output of AND gate 66 will be amplified by amplifier 54 and cause light emitting diode 90 to emit a 10 millisecond light pulse substantially once every 0.5 seconds. Such a visually perceptible indication at this particular repetition rate by LED 90 indicates, or is a signal of the fact that apparatus 10 is being tested and that it is operating properly.

To place apparatus 10 in its normal operating mode, switch 100 is opened. With battery voltage B+ within its predetermined normal limits, i.e., above 7.5 volts DC at the negative input terminal of op. amp. 45; clear air conditions existing in the atmosphere being monitored by ion chamber 15; and apparatus 10 operating properly, apparatus 10 goes into its normal operating or monitoring mode of operation. In its normal operating mode, the magnitude of the voltage applied to the negative input terminal of op. amp. 45 is greater than V4, and V1 is greater than V2 but less than V3. When this is the condition of apparatus 10, the output voltage of op. amp. 45 will be negative which is inverted by inverter 50 and applied as a positive or logic HIGH signal to amplifier 52 which causes the gate 60 to be closed, i.e., the constant current source 32 will be connected so that it can charge timing capacitor 42. Constant current source 33 is always available to charge capacitor 42 since it is wired into the circuit. Current from constant current source 34 will not be available to charge capacitor 42 since switch 61 opens at such time as switch 100 is opened. Thus timing capacitor 42 will be charged by the sum of the currents from current sources 32, 33. With timing capacitor 42 being charged at a rate determined by the sum of the currents from sources 32 and 33, oscillator 40 will, in the preferred embodiment, generate 10 millisecond output pulses at intervals of one every 10 seconds at the output of op. amp. 41, which positive pulses are transmitted as logic HIGHS to AND gates 65, 66, 67. As previously explained, if voltage V3 is greater than V1 and the output voltage of battery B as sensed by op. amp. 45 is greater than V4, the negative or logic LOW signals of op. amp. 45 and 47 are inverted by inverters 50, 51 to logic HIGHS which are applied to the input terminals of gate 66 so that when a positive output pulse from oscillator 40 is produced, gate 66 will conduct. The output signal of gate 66 will be amplified by amplifying circuit 54 which causes light emitting diode 90 to emit a pulse or burst of light. As a result LED 90 will be pulsed at 10 second intervals to provide a visually perceptible indication at a second repetition rate indicative of the fact that apparatus 10 is operating properly in its normal, or monitoring, mode and the atmosphere being monitored by ion chamber 15 is substantially within normal clear air conditions.

Upon the occurence of an alarm condition, for example when combustion products produced by a fire are present in the atmosphere and produce a reduction in the voltage of output terminal 16 of ion chamber 15, ion chamber voltage V1 will drop below alarm reference voltage V2. Upon V1 becoming less in magnitude than V2, the output of comparator 46 becomes positive or a logic HIGH. The logic HIGH from comparator 46 is applied to OR gate 70 and is transmitted through OR gate 70 to cause horn 97 to be energized by causing transistor drive circuit 96 to conduct. Horn 97 will remain energized as long as an alarm condition is detected by ion chamber 15, i.e., as long as V1 is less than V2. Thus a perceptible, i.e., audio signal is generated in the form of a continuous sounding of horn 97 to indicate that an alarm condition has been detected by apparatus 10.

It is noted that during the period an alarm condition is detected, apparatus 10 will continue to cause the light emitting diode 90 to flash at 10 second intervals, as in its normal operating mode, as long as that portion of the output voltage of battery B applied to the negative input terminal of op. amp. 45 is greater than V4. Thus, apparatus 10 positively indicates that its power source voltage level is sufficient even while detecting an alarm condition.

The detection of a fault or malfunction in the operation of apparatus 10 will now be explained. The sensitivity of apparatus 10 is determined by the magnitude of the difference between V1 and V2 under clear air conditions or between $V1_{CA}$ and V2. As mentioned above, in a preferred embodiment of apparatus 10, $V1_{CA}$ is 2 volts DC greater than V2. Needless to say, any significant increase in the difference between $V1_{CA}$ and V2 is indicative of apparatus malfunction and is further dangerous since the fire detection capability or sensitivity of the apparatus is thereby decreased. For example, if a 0.5 volt increase in the difference between $V1_{CA}$ and V2 would mean that combustion products in the atmosphere being monitored by ion chamber 15 would have to cause a decrease in V1 in excess of 2.5 volts to cause apparatus 10 to produce a alarm signal rather than the 2 volt drop for which a preferred embodiment of apparatus 10 is designed to operate.

Should such a fault or maladjustment of apparatus 10 occur, V1 becomes greater than V3 and a logic HIGH or positive signal is generated at the output of op. amp. 47. The logic HIGH on the output of op. amp. 47 is converted to a logic LOW by inverter 51 which logic LOW applied to one of the input terminals of AND gate 66 will disable AND gate 66 and as a result light emitting diode 90 will not be energized by output pulses produced by oscillator 40. At the same time a logic HIGH at the output of op. amp. 47, which is connected to one of the input terminals of AND gate 67, will enable AND gate 67 if the output voltage of battery B at the negative output terminal of op. amp. 45 is greater than V4. As a consequence, AND gate 67 will be enabled and positive output pulses produced by oscillator circuit 40 will pass through AND gate 67 to be amplified by amplifier 55 and energize light emitting diode 91. LED 91 will pulse at 10 second intervals in the same manner that LED 90 is pulsed during normal operation of apparatus 10 to provide a visually perceptible indication of an apparatus malfunction, or insensitivity, to the presence of smoke.

During use and operation of apparatus 10, the following will occur, if the voltage level of battery B at the negative input terminal of op. amp. 45 drops below V4. When this happens the output of op. amp. 45 will go positive and a logic HIGH will be generated. The logic HIGH output of op. amp. 45 is converted by inverter 50 to a logic LOW which is transmitted to one input terminal of AND gates 66 and 67 which will disable gates 66 and 67 and prevent LED's 90 and 91 from being energized. The logic HIGH output of op. amp. 45, which is inverted by inverter 50 into a negative or LOW logic signal, is amplified by amplifier 52 and causes gate 60 to open or become nonconductive. As a result of the opening of gate 60, only constant current source 33 is connected, or is available to charge timing capacitor 42. Thus during low battery voltage conditions capacitor 42 will be charged only by current from constant current source 33. As a result oscillator 40 will produce pulses at a slower, or third, repetition rate such as one output pulse every 30 seconds. The duration of each such output pulse, as explained before, will be substantially 10 milliseconds.

The logic HIGH signal produced by op. amp. 45 during the low battery voltage condition is also transmitted to one of the two input terminals of AND gate 65 which enables it. With AND gate 65 enabled, output pulses produced by oscillator circuit 40 are transmitted by gate 65 to one terminal of OR gate 70, pass through OR gate 70, and cause horn 97 to be energized. Thus during a condition of low battery, or power supply voltage, horn 97 is pulsed at 30 second intervals with each horn blast being approximately 10 milliseconds in duration. Thus, apparatus 10 will provide a perceptible pulsed audio signal which is indicative that a low power supply voltage has been described.

In describing apparatus 10, the components within block 110 have been described as if they were discreet or individual components. It is within the scope of this invention to have the components of block 110 formed on a single integrated circuit chip while some of the components outside of block 110 can be formed on integrated circuit chips or can be discreet components which are connected as illustrated schematically.

From the foregoing it is believed obvious that this invention provides a combustion products detection apparatus that can be tested to produce perceptible signals indicative of the fact that the apparatus is in good operating condition, that the condition and operation of the apparatus is normal, that an alarm condition has been detected, that the apparatus has detected that it has a malfunction, or that a low voltage power supply voltage has been detected.

It should be evident that various modifications can be made to the described embodiment without departing from the scope of the present invention.

What is claimed is:

1. A combustion products detection apparatus, comprising:

ion chamber means for monitoring the amount of combustion products present in a region to be monitored and for generating an ion chamber voltage whose magnitude is a function of the amount of combustion products present, the magnitude of the ion chamber voltage having a reference level, said reference level being the magnitude of the ion chamber voltage when the region being monitored is substantially free of combustion products, said ion chamber voltage changing in magnitude in a first sense as the amount of combustion products being monitored increases;

oscillator means for producing oscillator output pulses at predetermined rates;

test means operatively connected to the oscillator and having two states, said test means in its first state causing the oscillator to produce output pulses at a first repetition rate; and in its second state to produce oscillator output pulses at a second repetition rate different than said first repetition rate, said test means enabling the apparatus to be tested for proper operation;

first means for producing a perceptible output connected to the oscillator and operable to generate perceptible pulses corresponding to the output pulses of the oscillator means whereby the first means produces perceptible pulses at said first repetition rate whenever the test means is in its first state and produces perceptible pulses at said second repetition rate when said apparatus is in its second state;

means for generating an alarm reference voltage having a magnitude which differs in said first sense from the reference level of the ion chamber voltage by a predetermined amount;

first comparator means for comparing the ion chamber voltage with the alarm reference voltage and generating an alarm signal whenever the ion chamber voltage changes in said first sense beyond the alarm reference voltage; and, second means for producing a perceptible output connected to receive said alarm signal and for generating a perceptible output upon the receipt of same.

2. A combustion products detection apparatus comprising:

a source of electrical power;

ion chamber means for monitoring the degree of combustion products present in a region of atmosphere to be monitored, said ion chamber means being operable to generate an ion chamber voltage having a magnitude proportional to the degree of combustion products in the atmosphere being monitored, said ion chamber voltage having a reference voltage level when the atmosphere being monitored is in a substantially clear air state, said ion chamber voltage changing in magnitude in a first sense as the degree of combustion products in the atmosphere being monitored increases;

oscillator means having a timing capacitor for generating pulses at a rate proportional to the rate at which said timing capacitor is charged;

current source means made up of a plurality of substantially constant current generating sources wherein at least two current sources are switchably connected together for cumulatively charging said timing capacitor, said current source means being operable to generate a first current level to charge said timing capacitor whereby said oscillator means generates pulses at a first repetition rate;

first disabling means for disabling a first portion of said current source means to switch said apparatus from a test to an operational mode, said current source means being operable with said first portion of said current means disabled to generate a second current level different than said first current level whereby said oscillator means generates pulses at a second repetition rate different than said first repetition rate;

first means for emitting a perceptible output driven by said oscillator means operable to generate perceptible pulses corresponding to the pulses generated by said oscillator means whereby said first perceptible output emitting means generates perceptible pulses at said first repetition rate whenever said apparatus is in test mode and generates perceptible pulses at said second repetition rate whenever said apparatus is in an operational mode;

means for generating an alarm reference voltage having a magnitude of a preselected difference in said first sense from said ion chamber reference voltage level;

first comparator means for comparing said ion chamber voltage with said alarm reference voltage and generating an alarm signal whenever said ion chamber voltage changes in said first sense beyond said alarm reference voltage; and, second means for emitting a perceptible output connected to receive said alarm signal and operable to generate upon receipt of same a perceptible output corresponding thereto.

3. The invention defined in claim 2, including:

means for generating a fault reference voltage having a magnitude of a preselected difference in a second sense from said clear air ion chamber reference level, said second sense being opposite to said first sense;

second comparator means for comparing said ion chamber voltage with said fault reference voltage and generating a fault signal whenever said ion chamber voltage changes in said second sense beyond said fault reference voltage;

third means for emitting a perceptible output driven by said oscillator means operable when enabled to generate perceptible pulses corresponding to the pulses generated by said oscillator means, said third perceptible output emitting means being connected to receive said fault signal and being enabled by the receipt of same; and, said first perceptible output emitting means being connected to receive said fault signal and being disabled by the receipt of same.

4. The invention defined in claim 3, wherein:

the source of electrical power has a preselected level of voltage;

means for generating a supply voltage reference voltage having a magnitude of a selected difference below said preselected level of voltage;

third comparator means for comparing the level of voltage of the source of electrical power for the apparatus with said supply voltage reference voltage and generating a low power source signal whenever the voltage of the source of electrical power drops below said supply voltage reference voltage.

5. The invention defined in claim 4, wherein:

said first, second and third comparator means are operable to generate logic signals as said alarm signal, fault signal and low power source signal; and, said first, second and third perceptible output emitting means and means for enabling and disabling same include AND and OR gate means responsive to said logic signals.

6. The invention defined in claim 4, which further ncludes:

means for connecting said oscillator means to said second perceptible output emitting means, said connecting means when enabled being operable to connect said oscillator means to drive said second perceptible output emitting means, said connecting means being connected to receive said low power source signal and being enabled by the receipt of same; and, second disabling means for disabling said first and third perceptible output emitting means, said second disabling means connected to receive said low power source signal and being operable upon receipt of same to disable said first and third perceptible output generating means.

7. The invention defined in claim 6, including:

third disabling means for disabling a second portion of said current source means to switch said apparatus into a mode indicative that the voltage of the source of electrical power for the apparatus is low, said current source means being operable with said second portion of said current source disabled to generate a third current level different than said first and second current levels whereby said oscillator means generates pulses at a third repetition rate different than said first and second repetition rates.

8. The invention defined in claim 7, wherein:

said oscillator means generates uniform pulses at a rate directly proportional to the rate at which said timing capacitor is charged; and, said second current level is less than said first current level but greater than said third current level whereby said second repetition rate is greater than said third repetition rate.

9. The invention defined in claim 3, wherein:

said ion chamber voltage is inversely proportional to the degree of combustion products in the atmosphere being monitored; and, said ion chamber reference voltage level is greater than said alarm reference voltage but less than said fault reference voltage.

10. The invention defined in claim 9, wherein:

said first and third perceptible output emitting means each includes light emitting diode means for generating light or light pulses indicative of their driving signals; and, said second perceptible output emitting means includes horn means for generating sound or sound pulses indicative of its driving signal.

11. The invention defined in claim 3, wherein:

said first perceptible output emitting means includes light emitting diode means for generating light or light pulses indicative of its driving signal; and, said second perceptible output emitting means includes horn means for generating sound or sound pulses indicative of its driving signal.

12. The invention defined in claim 11, wherein:

said third perceptible output emitting means includes light emitting diode means for generating light or light pulses indicative of its driving signals.

13. A combustion products detection apparatus, comising:

ion chamber means for monitoring the degree of combustion products present in a region of atmosphere to be monitored, said ion chamber means being operable to generate an ion chamber voltage having a magnitude proportional to the degree of combustion products in the atmosphere being monitored, said ion chamber voltage having a reference voltage level when the atmosphere being monitored is in a substantially clear air state, said ion chamber voltage changing in magnitude in a first sense as the degree of combustion products in the atmosphere being monitored increases;

oscillator means having a timing capacitor for generating pulses at a rate proportional to the rate at which said timing capacitor is charged;

current source means made up of a plurality of substantially constant current generating sources wherein at least two current sources are switchably connected together for cumulatively charging said timing capacitor, said current source means being operable to generate a first current level to charge said timing capacitor whereby said oscillator means generates pulses at a first repetition rate;

first disabling means for disabling a first portion of said current source means to switch said apparatus from a test to an operational mode, said current source means being operable with said first portion of current means disabled to generate a second current level different than said first current level whereby said oscillator means generates pulses at a second repetition rate different than said first repetition rate;

first means for emitting a perceptible output driven by said oscillator means operable to generate perceptible pulses corresponding to the pulses generated by said oscillator means whereby said first perceptible output emitting means generates perceptible pulses at said first repetition rate whenever said apparatus is in the test mode and generates perceptible pulses at said second repetition rate whenever said apparatus is in the operational mode; and alarm means connected to said ion chamber means for generating an alarm signal indicating the presence of a predetermined concentration of combustion products present in the region being monitored.

14. A combustion products detection apparatus, comprising:

a source of power;

ion chamber means for monitoring the degree of combustion products present in a region of atmosphere to be monitored, said ion chamber means being operable to generate an ion chamber voltage having a magnitude proportional to the degree of combustion products in the atmosphere being monitored, said ion chamber voltage having a reference voltage level when the atmosphere being monitored is in a substantially clear air state, said ion chamber voltage changing in magnitude in a first sense as the degree of combustion products in the atmosphere being monitored increases;

oscillator means for producing oscillator output pulses at predetermined rates;

alarm means connected to said ion chamber means for generating an alarm signal indicating the presence of a predetermined concentration of combustion products present in the region being monitored;

means for generating a fault reference voltage;

means connected to said ion chamber means for generating a fault signal whenever said ion chamber voltage changes in magnitude in a second sense relative to said fault reference voltage;

means for generating a power source reference voltage;

means connected to said source of power for generating a low power source signal whenever said source of power changes in a first sense from said power source reference voltage;

first perceptible output emitting means responsive to said oscillator means and said ion chamber means for producing a perceptible output;

second perceptible output emitting means responsive to said ion chamber means for producing a perceptible output whenever said alarm signal is present;

third perceptible output emitting means responsive to said ion chamber means for producing a perceptible output whenever said fault signal is present; and second disabling means connected to said low power source signal for disabling said first and third perceptible output emitting means when said low power source signal is present.

15. The invention as defined in claim 14, wherein;

said second disabling means includes AND gate means responsive to said oscillator output pulses, said fault signal, and said low power source signal.

16. A combustion products detection apparatus, comprising:

a source of power;

ion chamber means for monitoring the degree of combustion products present in a region of atmosphere to be monitored, said ion chamber means being operable to generate an ion chamber voltage having a magnitude proportional to the degree of combustion products in the atmosphere being monitored, said ion chamber voltage having a reference voltage level when the atmosphere being monitored is in a substantially clear air state, said ion chamber voltage changing in magnitude in a first sense as the degree of combustion products in the atmosphere being monitored increases;

oscillator means having a timing capacitor for generating pulses at a rate proportional to the rate at which said timing capacitor is charged;

current source means made up of a plurality of substantially constant current generating sources wherein at least two current sources are switchably connected together for cumulatively charging said timing capacitor, the rate of charge of said timing capacitor depending upon the presence of at least one predetermined condition;

first means for emitting a perceptible output driven by said oscillator means operable to generate perceptible pulses corresponding to the pulses generated by said oscillator means; and alarm means connected to said ion chamber means for generating an alarm signal indicating the presence of a predetermined concentration of combustion products present in the region being monitored.

17. The invention as defined in claim 16, further including:

means for generating a power source reference voltage;

means connected to said source of power for generating a low power source signal whenever said source of power changes in a first sense from said power source reference voltage; and third disabling means connected to said current source means for disabling a portion of said current source means whenever said low power source signal is present so that said timing capacitor is charged at a rate different than when said portion of said current source means is enabled.

18. A combustion products detection apparatus, comprising:

a source of power;

ion chamber means for monitoring the degree of combustion products present in a region of atmosphere to be monitored, said ion chamber means being operable to generate an ion chamber voltage having a magnitude proportional to the degree of combustion products in the atmosphere being monitored, said ion chamber voltage having a reference voltage level when the atmosphere being monitored is in a substantially clear air state, said ion chamber voltage changing in magnitude in a first sense as the degree of combustion products in the atmosphere being monitored increases;

oscillator means for producing oscillator output pulses at predetermined rates;

alarm means connected to said ion chamber means for generating an alarm signal indicating the presence of a predetermined concentration of combustion products present in the region being monitored;

means for generating a fault reference voltage;

means connected to said ion chamber means for generating a fault signal whenever said ion chamber voltage changes in magnitude in a second sense relative to said fault reference voltage;

first perceptible output emitting means responsive to said oscillator means and said ion chamber means for producing a perceptible output;

second perceptible output emitting means responsive to said ion chamber means for producing a perceptible output whenever said alarm signal is present;

third perceptible output emitting means responsive to said ion chamber means for producing a perceptible output whenever said fault signal is present; and fourth disabling means connected to said fault signal for disabling said first perceptible output emitting means when said fault signal is present.

19. The invention defined in claim 18, wherein:

said fourth disabling means includes AND gate means responsive to said oscillator output pulses, said low power source signal, and said fault signal.

* * * * *